US010039368B2

(12) United States Patent
Christman

(10) Patent No.: US 10,039,368 B2
(45) Date of Patent: Aug. 7, 2018

(54) STRAPPING SYSTEM

(71) Applicant: Heidi Christman, Deshler, OH (US)

(72) Inventor: Heidi Christman, Deshler, OH (US)

(73) Assignee: ADELLA PRODUCTS, LLC, Deshler, OH (US)

( * ) Notice: Subject to any disclaimer, the term of this patent is extended or adjusted under 35 U.S.C. 154(b) by 30 days.

(21) Appl. No.: 15/224,896

(22) Filed: Aug. 1, 2016

(65) Prior Publication Data

US 2017/0027308 A1 Feb. 2, 2017

Related U.S. Application Data

(60) Provisional application No. 62/199,339, filed on Jul. 31, 2015.

(51) Int. Cl.

| | |
|---|---|
| ***A45F 5/00*** | (2006.01) |
| ***A45F 3/14*** | (2006.01) |
| *A45F 5/10* | (2006.01) |

(52) U.S. Cl.

CPC ..... *A45F 3/14* (2013.01); *A45F 2003/142* (2013.01); *A45F 2005/1013* (2013.01); *A45F 2005/1033* (2013.01)

(58) Field of Classification Search

CPC ..... A45F 3/14; A45F 2003/142; A45F 2005/1013; A45F 2005/1033

USPC ..... 294/157, 149, 150, 154

See application file for complete search history.

(56) References Cited

U.S. PATENT DOCUMENTS

| | | | | | |
|---|---|---|---|---|---|
| 154,283 | A | * | 8/1874 | Roemer | A45F 5/10 294/154 |
| 164,994 | A | * | 6/1875 | Harrell | A45F 5/10 294/154 |
| 187,716 | A | * | 2/1877 | Kirk | A45F 5/10 294/150 |
| 822,349 | A | * | 6/1906 | Connett | A45F 5/10 294/154 |
| 1,141,005 | A | * | 5/1915 | Reipsnyder | A45F 5/10 229/117.09 |
| 1,237,243 | A | * | 8/1917 | Conner | A47C 27/001 294/154 |
| 1,243,638 | A | * | 10/1917 | Spurrier | A45F 5/10 294/154 |
| 1,847,501 | A | * | 3/1932 | Stahler | A45F 5/10 294/157 |
| 2,978,154 | A | * | 4/1961 | Theodore | A45F 5/10 294/154 |
| 4,556,245 | A | * | 12/1985 | Gruenwald | A45F 5/10 16/110.1 |
| 4,804,218 | A | * | 2/1989 | Hilliard | B63C 11/22 294/157 |
| 4,911,347 | A | | 3/1990 | Wilhite | |

(Continued)

FOREIGN PATENT DOCUMENTS

| | | | | | |
|---|---|---|---|---|---|
| GB | 629769 | A | * | 9/1949 | A45F 3/14 |

*Primary Examiner* — Gabriela M Puig

(74) *Attorney, Agent, or Firm* — Shumaker, Loop & Kendrick, LLP; James D. Miller

(57) ABSTRACT

A strapping system for transporting and storing an object includes a pair of elongate engagement straps. Each of the pair of elongate straps include a coupling configured to position each of the pair of elongate engagement straps into a loop configured to engage the object. A handle is slideably receiving and extending between the pair of elongate engagement straps.

12 Claims, 4 Drawing Sheets

(56) References Cited

U.S. PATENT DOCUMENTS

| | | | | |
|---|---|---|---|---|
| 5,083,692 | A | 1/1992 | Treese | |
| D343,266 | S | 1/1994 | Gromer | |
| D368,372 | S | 4/1996 | Dennison | |
| 5,558,382 | A * | 9/1996 | Wengler | A45C 13/38 294/157 |
| 5,603,545 | A | 2/1997 | Benson et al. | |
| D390,704 | S | 2/1998 | Bloch | |
| 5,746,361 | A | 5/1998 | Johnson | |
| 5,752,733 | A * | 5/1998 | Marshall | A45F 3/14 294/154 |
| 5,927,781 | A | 7/1999 | Lyons, Jr. | |
| 6,065,790 | A * | 5/2000 | Oswald | A01K 27/00 224/921 |
| 6,457,762 | B1 | 10/2002 | Garutti | |
| 7,390,042 | B1 | 6/2008 | Miller | |
| D591,008 | S | 4/2009 | Barringer | |
| 7,971,763 | B2 | 7/2011 | Chace | |
| 7,976,088 | B1 * | 7/2011 | Diciolla | A45C 13/30 294/154 |
| 8,061,750 | B1 | 11/2011 | Hamilton | |
| 9,072,366 | B2 | 7/2015 | Jenson et al. | |
| 2004/0145202 | A1 * | 7/2004 | Dela Paz | A45F 3/14 294/157 |
| 2006/0043135 | A1 | 3/2006 | Lindsey | |

* cited by examiner

STRAPPING SYSTEM

CROSS-REFERENCE TO RELATED PATENT APPLICATIONS

This patent application claims the benefit of U.S. Provisional Patent Application No. 62/199,339, filed on Jul. 31, 2015. The entire disclosure of the above patent application is hereby incorporated herein by reference.

FIELD

The disclosure generally relates to a strapping system, in particular, a strapping system for compressing, carrying, and storing articles such as tarps and other flexible sheet material.

BACKGROUND

Flexible sheet material such as tarps, covers for open-top trucks and trailers, pool covers, material used in erecting tents, canvases, boat covers, and recreational sports covers, for example, are commonly employed to cover and protect objects and surface areas. The sheet materials can be relatively large depending on the object or surface area being covered. When not in use, the sheet materials typically need to be stored.

However, these types of sheet materials can be unwieldy and difficult to transport or store due to a size and a composition thereof. Often, the sheet materials are loosely rolled, folded, or piled and moved to a storage facility and usually positioned on the floor or stored outside. Even when stored in the rolled, folded, or piled form, the materials can take up considerable undesired space because they do not easily compact or compress.

Accordingly, there is a continuing need for a system that allows for a flexible sheet material to be easily transported and stored. Desirably, the system is ergonomically enhanced, simple to use, adjustable to accommodate a variety of sheet material sizes and compositions, and facilitates compacting of the sheet material for storage.

SUMMARY

In concordance with the instant disclosure, a system that allows for a flexible sheet material to be easily transported and stored. Desirably, the system is ergonomically enhanced, simple to use, adjustable to accommodate a variety of sheet material sizes and compositions, and facilitates compacting of the sheet material for storage has surprisingly been discovered.

In one embodiment, a strapping system for an object includes a pair of elongate engagement straps. Each of the pair of elongate straps include a releaseable coupling configured to form a loop with each of the pair of elongate engagement straps to engage the object. A handle is slideably receiving and extending between the pair of elongate engagement straps.

In another embodiment, a strapping system is disclosed. The strapping system includes a first elongate engagement strap. The first elongate engagement strap includes a first coupling releasably engaging a first end of the first elongate engagement strap to a second end of first elongate engagement strap. A second elongate engagement strap is spaced from the first elongate engagement strap. The second elongate engagement strap includes a second coupling releasably engaging a first end of the second elongate engagement strap to a second end of the second elongate engagement strap. A slideably receives the first elongate engagement strap at a first end of the handle and the second elongate engagement strap at a second end of the handle.

In yet another embodiment, a strapping system assembly is disclosed. The strapping assembly includes and object and a pair of elongate engagement straps each configured to form a loop. The loop of each of the pair of elongate engagement straps releasably engage and compress the object. The handle extends between the pair of elongate engagement straps. A transporting strap extends between the pair of elongate engagement straps and is configured for transporting and storing the object.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
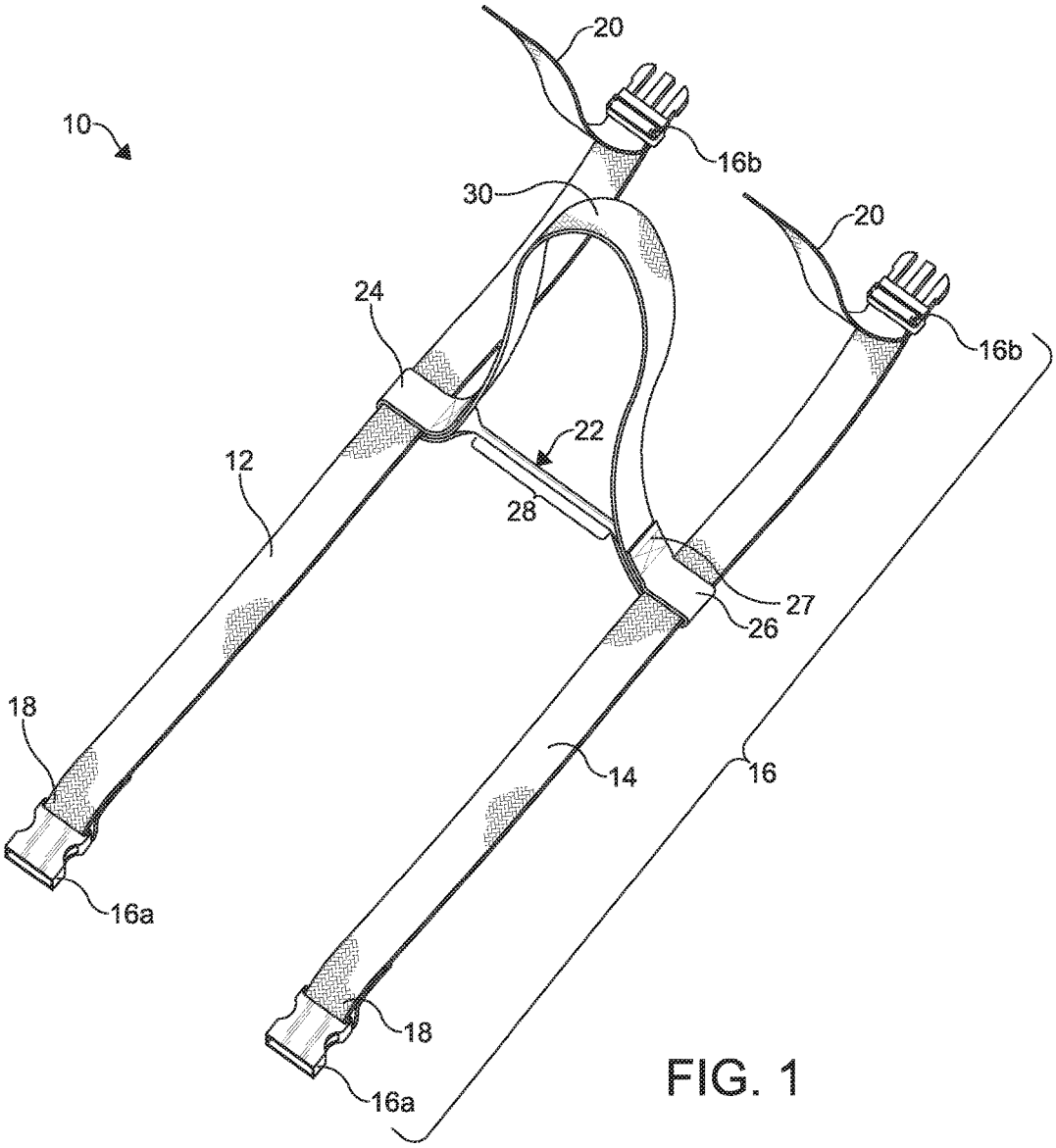
FIG. 1 illustrates a top perspective view of a strapping system according to an embodiment of the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Figure 2:
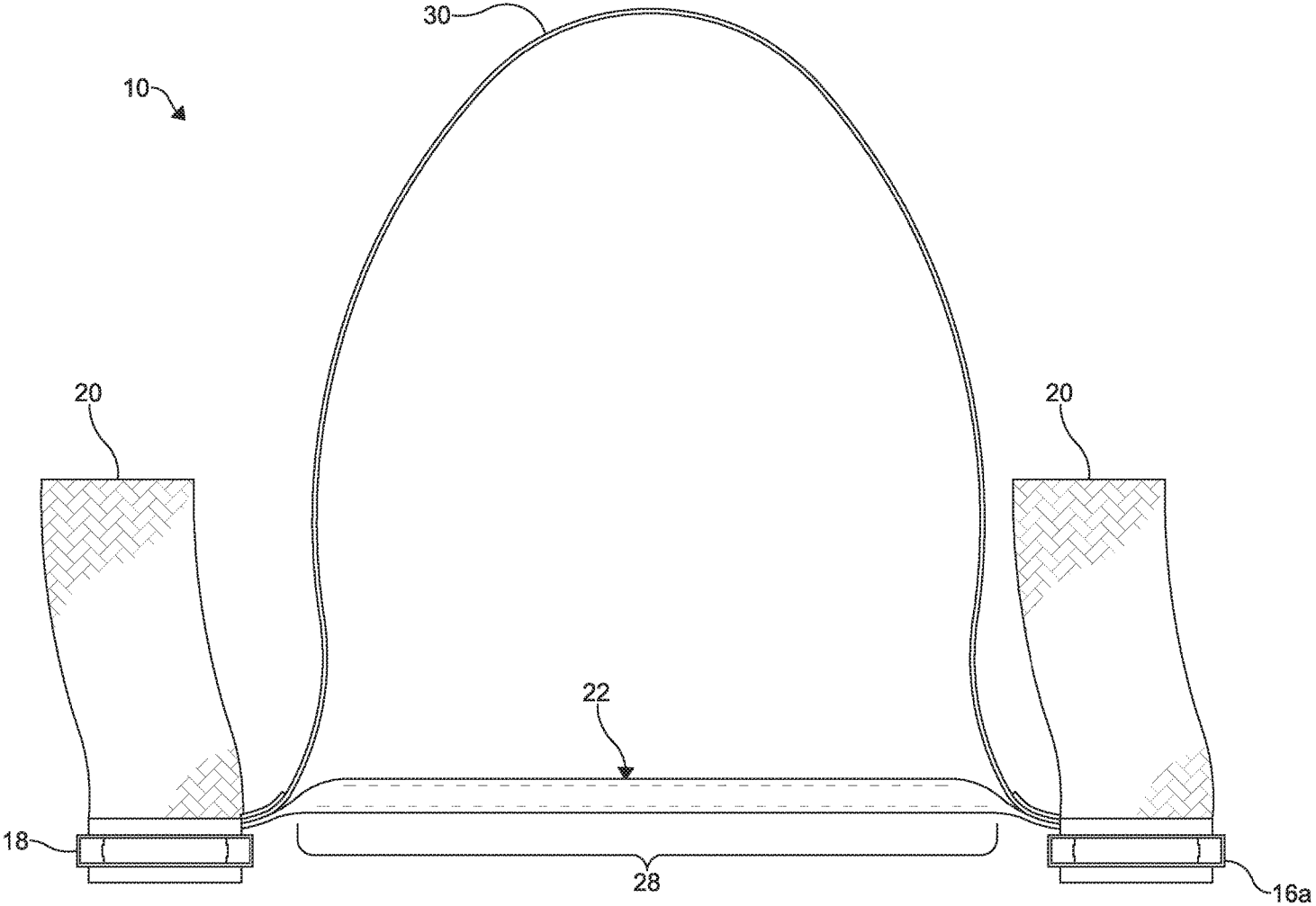
FIG. 2 illustrates a front elevational view of the strapping system of FIG. 1.
Figure 3:
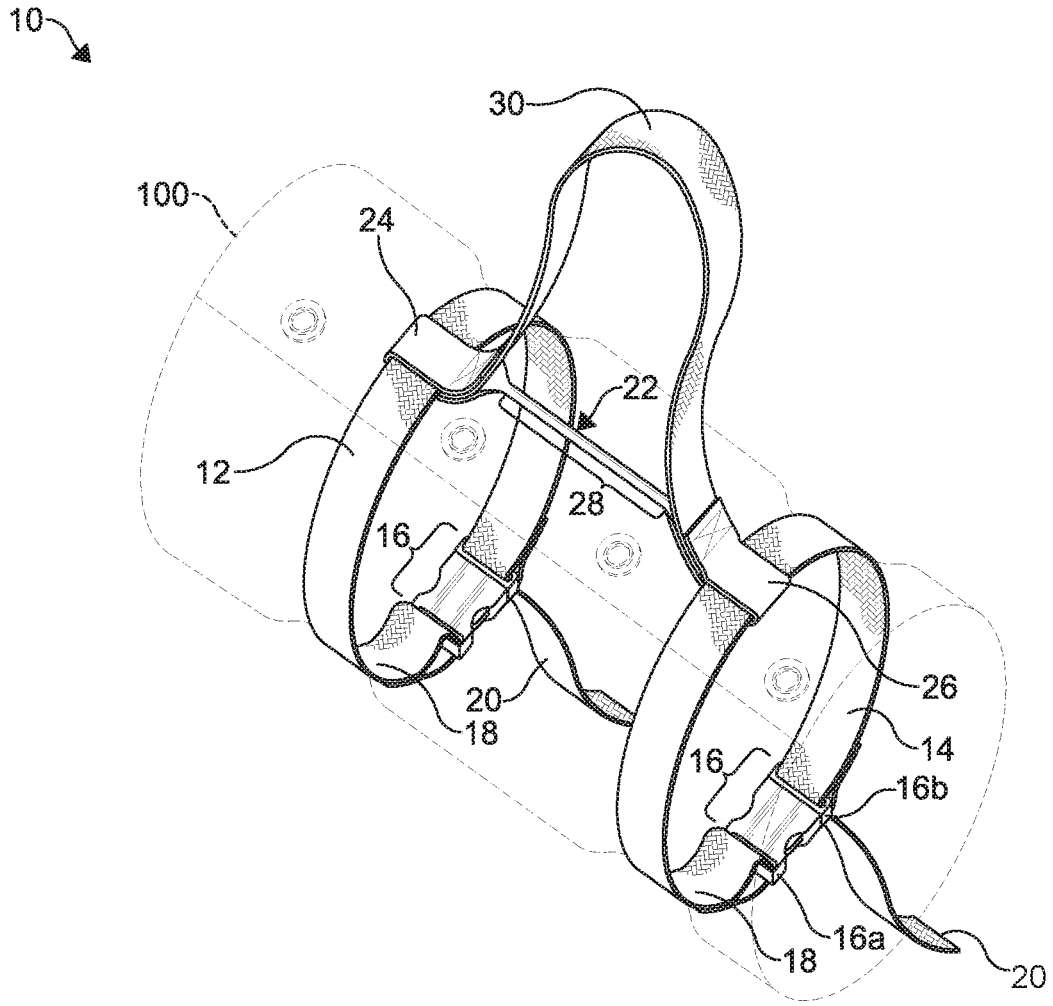
FIG. 3 illustrates a top perspective view of the strapping system of FIGS. 1-2 engaging an object.
Figure 4:
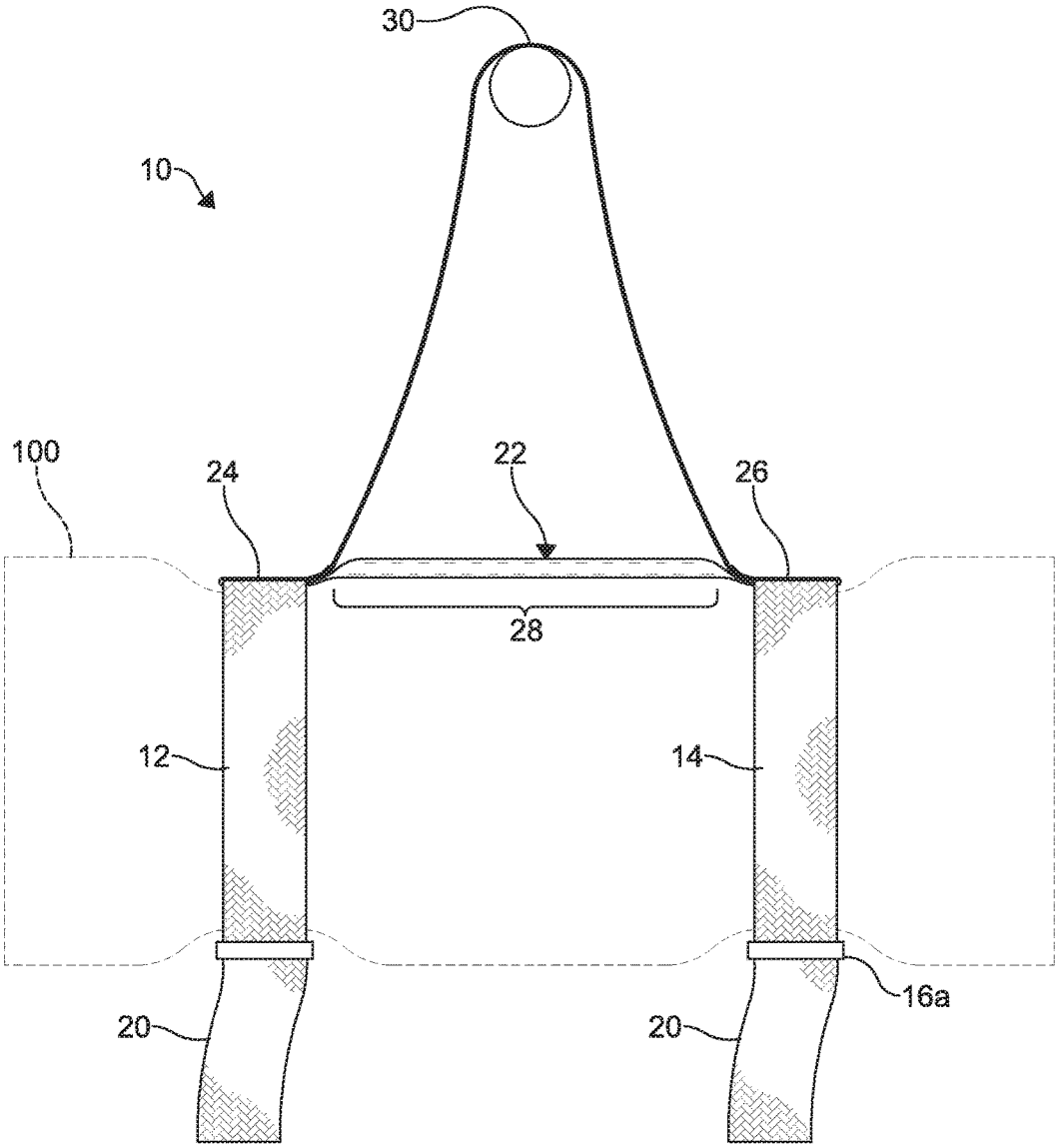
FIG. 4 illustrates a front elevational view of the strapping system of FIGS. 1-2 engaging an object and in a stored position.

FIGS. 1-4 illustrate a strapping system 10 according to the present disclosure. The strapping system 10 facilitates lifting, compressing, securing, and storing an object 100. The strapping system 10 includes a pair of elongate engagement straps, also herein designated as a first engagement strap 12 and a second engagement strap 14. Each of the engagement straps 12, 14 includes an adjustable releasable coupling 16. In the embodiment illustrated, the couplings 16 are adjustable side release buckles, wherein a female end 16*a* of the buckle is fixed to a first end 18 of each of the engagement straps 12, 14 and a male end 16*b* of the buckle is adjustably coupled to a second end 20 of each of the engagement straps 12, 14. The male end 16*b* is moveable between the second end 20 and the first end 18. However, it is understood the couplings 16 can be any other couplings permitting adjustment of the engagement straps 12, 14 such as a hook and loop system, clamping mechanisms, or other styles of couplings, for example.

A handle 22 extends between the engagement straps 12, 14. A first loop 24 is formed at the first end of the handle 22 for slidably receiving the first engagement strap 12 and a second loop 26 is formed at the second end of the handle 22 for slidably receiving the second engagement strap 14. The loops 24, 26 permit the handle 22 to slide with respect to the engagement straps 12, 14. The loops 24, 26 are formed by looping the ends of the handle 22 and connecting the ends of the handle 22 to a connection portion 27 of the handle 22 spaced from the ends with connection means such as sewn thread. However, other connection means such as staples, adhesive, bonding, or other connection means can be employed as desired. A center grip portion 28 of the handle 22 envelopes a piece of flexible material to both stiffen and thicken the handle 22 and allow the handle 22 to be easily and comfortably gripped.

A transporting strap 30 extends from adjacent the first loop 24 to adjacent the second loop 26 of the handle 22. The transporting strap 30 has a length greater than a length of the handle 22 and cooperates with the handle 22 to form a loop configured for carrying the object 100 with an arm or shoulder of a user and hanging the object 100 for storage. In certain embodiments, each of the ends of the transporting strap 30 are fixed to the connection portion 27 with the same connection means employed to form the loops 24, 26 of the handle 22. However, in other embodiments, each of the ends of the transporting strap 30 can be connected to other portions of the handle 22 as desired.

The engagement straps 12, 14, the handle 22, and the transporting strap 30 are formed from a material that is sufficiently strong and flexible to accommodate, carry, and store the object 100. For example, the engagement straps 12, 14, the handle 22, and the transporting strap 30 can be formed form a polypropylene webbing, a nylon webbing, a polyester webbing or a combination thereof. Although, other materials can be contemplated if desired.

The strapping system 10 is employed and advantageous for transporting and storing the object 100. For example, the strapping system 10 is particularly advantageous for transporting and storing flexible sheet material such as tarps, covers for open-top trucks and trailers, pool covers, material used in erecting tents, canvases, boat covers, recreational sports covers, and the like, for example, which are commonly employed to cover and protect objects and surface areas. However, it is understood the strapping system 10 can be employed for transporting and storing other types of objects, if desired.

In use, the object 100 such as the flexible sheet material is folded and rolled into a substantially cylindrical shape. The engagement straps 12, 14 are looped around the folded and rolled object 100 and preferably centered around the object 100. The female end 16*a* of each of the couplings 16 engages the male end 16*b* to form a loops of each of the engagement straps 12, 14 and secure the loop around and engage the object 100. The second end 20 of the engagement straps 12, 14 can be held to adjust the position of the male end 16*b* of the engagements straps 12, 14. By pulling the second end 20 of the engagement straps 12, 14 and moving the male end 16*b* towards the first end 18 of the engagement straps 12, 14, the loop formed by coupling the male end 16*b* to the female end 16*a* is thereby shortened, permitting the engagement straps 12, 14 to compress the object 100. To loosen the engagement straps 12, 14 with respect to the object 100, the second end 20 can be held and the male end 16*b* can be moved towards the second end 20 of the engagement straps 12, 14. The engagement straps 12, 14 can be slidably adjusted through the loops 24, 26 by moving the handle 22 towards the first end 18 or the second end 20 of the engagement straps 12, 14. The transporting strap 30 can then be carried on the arm or shoulder of the user and used to hang the object 100 on a hook, bracket, hanger or the like.

Advantageously, the strapping system 10 ergonomically facilitates transporting and storing the object 100. The strapping system 10 facilitates compressing the object 100 such as the sheet material object 100, and can be stored in a systematic, compact, and convenient manner. The strapping system 10 is easily adjustable to accommodate carrying and storing varying sizes of the object 100.

While certain representative embodiments and details have been shown for purposes of illustrating the invention, it will be apparent to those skilled in the art that various changes may be made without departing from the scope of the disclosure, which is further described in the following appended claims.

What is claimed is:

1. A strapping system for an object comprising:

a first elongate engagement strap, the first elongate engagement strap including a first coupling releasably engaging a first end of the first elongate engagement strap to a second end of first elongate engagement strap, wherein the first coupling includes a female end releasably engaging the first end of the first elongate engagement strap and a male end adjustably coupled to the second end of the first elongate engagement strap, and wherein the male end of the first coupling is movable between the first end and the second end of the first elongate engagement strap;

a second elongate engagement strap spaced from the first elongate engagement strap, the second elongate engagement strap including a second coupling releasably engaging a first end of the second elongate engagement strap to a second end of the second elongate engagement strap, wherein the second coupling includes a female end fixed to the first end of the second elongate engagement strap and a male end adjustably coupled to the second end of the second elongate engagement strap, and wherein the male end of the second coupling is movable between the first end and the second end of the second elongate engagement strap;

a flexible handle slideably receiving the first elongate engagement strap at a first end of the handle and the second elongate engagement strap at a second end of the handle, wherein a first loop is formed at the first end of the handle for slideably receiving the first elongate engagement strap and a second loop is formed at the second end of the handle for slidably receiving the second elongate engagement strap, wherein the first end of the handle is looped about the first elongate engagement strap and connected to a first connection portion of the handle adjacent an inner side of the first elongate engagement strap, and wherein the second end of the handle is looped about the second elongate engagement strap and connected to a second connection portion of the handle adjacent an inner side of the second elongate engagement strap; and a flexible transporting strap extending between the first connection portion and the second connection portion, wherein a first end of the transporting strap is fixed between the first connection portion and the first end of the handle and fixed to the first connection portion and a second end of the transporting strap is fixed between the second connection portion and the second end of the handle and fixed to the second connection portion, and wherein the transporting strap has a length greater than a length of the handle.

2. The strapping system of claim 1, wherein the handle has a center grip portion configured to stiffen the handle.

3. The strapping system of claim 2, wherein the center grip portion envelopes a rigid material configured to stiffen the handle.

4. The strapping system of claim 1, wherein the first and second of elongate engagement straps and the handle are formed from the same material.

5. The strapping system of claim 4, wherein the first and second of elongate engagement straps and the handle are formed from a polypropylene webbing.

6. The strapping system of claim 4, wherein the first and second elongate engagement straps and the handle are formed from a nylon webbing.

7. The strapping system of claim 4, wherein the first and second elongate engagement straps and the handle are formed from a polyester webbing.

8. The strapping system of claim 1, wherein the first and second elongate engagement straps are configured to compress the object.

9. The strapping system of claim 1, wherein the first coupling and the second coupling are adjustable and releasable buckles.

10. The strapping system of claim 1, wherein the first end of the handle and the first end of the transporting strap are connected to the first connection by a first connection means and the second end of the handle and the second end of the transporting strap are connected to the second connection by a second connection means.

11. A strapping system assembly comprising:

an object;

a pair of elongate engagement straps, each of the pair of engagement straps configured to form a loop, the loop of each of the pair of elongate engagement straps releasably engaging and compressing the object;

a handle extending between the pair of elongate engagement straps, wherein a first loop is formed at a first end of the handle for slideably receiving a first one of the pair of elongate engagement straps and a second loop is formed at a second end of the handle for slidably receiving a second one of the pair of elongate engagement straps, wherein the first end of the handle is looped about the first one of the pair of elongate engagement straps and connected to a first connection portion of the handle adjacent an inner side of the first one of the pair of elongate engagement straps, and wherein the second end of the handle is looped about the second one of the pair of elongate engagement straps and connected to a second connection portion of the handle adjacent an inner side of the second one of the pair of elongate engagement straps; and a transporting strap extending between the pair of elongate engagement straps configured for transporting and storing the object, wherein a first end of the transporting strap is fixed between the first connection portion and the first end of the handle and fixed to the first connection portion and a second end of the transporting strap is fixed between the second connection portion and the second end of the handle and fixed to the second connection portion, and wherein the transporting strap has a length greater than a length of the handle.

12. The strapping system of claim 11, where the object is a flexible sheet material formed into a cylindrical shape.

* * * * *